United States Patent [19]

Reese

[11] Patent Number: 5,034,174

[45] **Date of Patent: * Jul. 23, 1991**

[54] TEXTURING YARNS

[75] Inventor: Cecil E. Reese, Kinston, N.C.

[73] Assignee: E. I. Du Pont de Nemours and Company, Wilmington, Del.

[ * ] Notice: The portion of the term of this patent subsequent to Oct. 30, 2007 has been disclaimed.

[21] Appl. No.: 591,123

[22] Filed: Oct. 1, 1990

Related U.S. Application Data

[60] Division of Ser. No. 402,005, Sep. 1, 1989, which is a continuation-in-part of Ser. No. 907,299, Sep. 12, 1986, abandoned.

[51] Int. Cl.[5] ..... D01D 5/22; D01D 5/12

[52] U.S. Cl. ..... 264/103; 264/168; 264/210.2; 264/210.6; 264/210.8; 264/211; 57/282; 57/288; 57/310

[58] Field of Search ..... 264/210.6, 210.8, 211, 264/103, 210.2, 168; 57/282, 288, 310

[56] References Cited

U.S. PATENT DOCUMENTS

| | | | |
|---|---|---|---|
| 3,576,773 | 4/1971 | Vaginay et al. | 528/296 |
| 3,771,307 | 11/1973 | Petrille | 57/157 |
| 3,772,872 | 11/1973 | Piazza et al. | 57/140 R |
| 4,092,299 | 5/1978 | MacLean et al. | 260/75 T |
| 4,113,704 | 9/1978 | MacLean et al. | 528/289 |
| 4,217,440 | 8/1980 | Barkey | 528/274 |
| 4,966,740 | 10/1990 | Reese | 264/210.8 |

*Primary Examiner*—Jan H. Silbaugh
*Assistant Examiner*—Brian Jones

[57] ABSTRACT

Modifying a polyester with special chain-brancher residues in carefully controlled amounts to provide a draw-texturing feed yarn that can be draw-textured at a speed of 1,000 mpm without excessive filament breaks, and with other advantages in the resulting textured yarns, such as improved bulk and dyeability over prior polyester yarns that could not be satisfactorily textured under similar conditions.

6 Claims, 2 Drawing Sheets

TEXTURING YARNS

CROSS-REFERENCE TO RELATED APPLICATION

This is a division of application Ser. No. 07/402,005, filed Sept. 1, 1989, which is a continuation-in-part of application, Ser. No. 06/907,299, filed Sept. 12, 1986 abandoned.

TECHNICAL FIELD OF THE INVENTION

This invention concerns improvements in and relating to texturing yarns, and is more particularly concerned with improved polyester draw-texturing feed yarns having a capability of being draw-textured at high speeds without excessive broken filaments and with other advantages, to such high speed process of draw-texturing, and to a process for preparing such feed yarns.

BACKGROUND OF THE INVENTION

The preparation of textured polyester multifilament yarns has been carried out commercially on a worldwide scale for many years. The simultaneous draw-texturing by a false-twist texturing process of partially oriented feed yarns of low crystallinity prepared by spin-orienting, i.e., withdrawing the melt-spun polyester filaments at high withdrawal speeds of, e.g., 3,000 ypm, was disclosed by Petrille in U.S. Pat. No. 3,771,307, and the feed yarns were disclosed by Piazza and Reese in U.S. Pat. No. 3,772,872. Use of these spin-oriented feed yarns has made possible significant increases in texturing speeds. In about 1970, commercially-available texturing machines (false-twist texturing) were capable of maximum speeds only of the order of about 200 mpm (meters per minute). For several years now, owing to improvements in machinery design, draw-texturing machines have been commercially available with a capability of operating at very high speeds of, e.g., 1,000 mpm or more. Despite the availability of such machines, capable of machine operation at such desirable very high speeds, commercially-available draw-texturing polyester feed yarns (DTFY) have not been textured commercially at the very high speeds of which the machines are capable. This is mainly because of the excessive number of broken filaments produced at these very high speeds. Any broken filaments are undesirable, since they may cause difficulties, and even yarn breaks, during subsequent processing, and also fabric defects. The number of broken filaments that may be tolerated in practice will depend upon the intended use for the textured yarn and eventual fabric In practice, in the trade, the ends of the bobbin are examined for broken filaments, and the number of protruding broken filaments is counted so as to give a measure of the probable number of broken filaments in the yarn of that package The total number of these broken filaments counted is then divided by the number of pounds in the package and expressed as BFC. For certain end uses, the maximum that can be tolerated is between 0.5 and 0.6 BFC, i.e., between 5 and 6 broken filaments for every 10 lbs. of polyester yarn, it being understood that one break will probably count as two broken filaments Thus, for any texturer having a texturing machine capable of operation at 1,000 mpm or more, if the polyester draw-texturing feed yarns commercially available cannot be processed on this machine at more than about 850 mpm without significantly exceeding the desired maximum (e.g.,about 0.5 BFC), he will be forced in practice to operate his machines at this speed of 850 mpm instead of increasing the speed to the maximum capability of the machine. Despite the obvious commercial incentive to provide polyester draw-texturing feed yarns capable of being draw-textured at speeds of more than 1,000 mpm without excessive BFC, however, hitherto, this problem of providing a commercially-satisfactory feed yarn has not yet been solved.

I have found it possible to increase texturing speeds without causing excessive broken filaments by increasing the withdrawal speed used to obtain the desired spin-orientation in the feed yarn. Such feed yarns, prepared at relatively high withdrawal speeds of 4,000 mpm, have not been textured commercially on a large scale because of accompanying disadvantages, mainly that the resulting textured yarns have not been as bulky as yarns that are already available commercially. Bulk is generally measured as CCA, a value of at least about 4 being considered desirable, or as TYT, a value of over 20 being considered desirable, generally, at this time.

The problem that has faced the industry, therefore, has been to provide a polyester multifilament draw-texturing feed yarn (DTFY) that is capable of being draw-textured on existing commercial machines at a speed of at least 1,000 mpm and yet of providing a package of textured yarn with, by way of example, not more than about 0.5 BFC and over 20 TYT, it being understood that such FIGURES depend very much on economic and other commercial considerations and on what competitors are prepared to offer at any time. Generally, with the passage of time, the demands of any industry tend to increase.

SUMMARY OF THE INVENTION

The present invention provides a solution to this problem. In one aspect of the invention, there is provided a process whereby an improved new polyester feed yarn can be draw-textured at high speeds to give yarns of satisfactory texture without excessive BFC. In another aspect, improved new polyester feed yarns are provided, whereby this problem can be solved. In a further aspect, there is provided a process for preparing these improved new feed yarns. In a further aspect, use of the feed yarns can provide other advantages, even when increased speed of texturing is not necessary or desirable.

According to one aspect of the invention, there is provided a continuous process for preparing polyester draw-texturing feed yarns, involving the steps of first forming a molten polyester by reaction (a) of ethylene glycol with terephthalic acid and/or esters thereof, followed by polycondensation (b), these reaction steps being carried out in the presence of appropriate catalysts therefor, and then melt-spinning the resulting molten polyester into filaments and withdrawing them at a speed of about 3,000 to 4,000 mpm, preferably at speeds in the lower portion of this range, such as about 3,000 to 3,200 mpm, to provide partially oriented yarns of low crystallinity, wherein the polyester is modified by introducing into the polymer, as a solution in ethylene glycol, a substance selected from the group consisting of trimesic acid, trimellitic acid or an ester thereof (i.e an ester of either trimellitic or trimesic acid) in amount as indicated approximately by the line AB of FIG. 1 of the accompanying drawing.

According to another aspect of the invention, there is provided a partially oriented polyester multifilament draw-texturing feed yarn of low crystallinity, as shown by a boil-off shrinkage of about 45% and an elongation to break of about 155%, consisting essentially of polymerized ethylene terephthalate residues chain-branched with trimellitate or trimesate residues in amount about 6 MEQ, and of relative viscosity about 21 LRV. Alternatively, the boil-off shrinkage may be about 20–25%, the elongation to break about 133%, and the amount of trimesate or trimellitate residues about 4 MEQ. The elongation (to break) is a measure of orientation (as is birefringence), the elongation being reduced as the spin-orientation is increased, while the shrinkage is affected by the crystallinity, as well as the orientation, and is reduced as the crystallinity increases. Thus, there is provided a multifilament draw-texturing feed yarn that has been prepared by polymerizing ethylene (glycol) and terephthalate derivatives (terephthalic acid, dimethylterephthalate) with trimesate or trimellitate residues acting as chain-brancher and by spin-orienting at a withdrawal speed of at least about 3,000 to 4,000 mpm, preferably a lower speed, such as about 3,000 to 3,200 mpm, and that is capable of being draw-textured at a speed of at least 1,000 mpm to provide a package of textured yarn with not more than about 0.5 BFC and a TYT of over 20.

According to a further aspect of the invention, there is provided a process for preparing a false-twist textured yarn, wherein a multifilament polyester feed yarn is subjected to simultaneous draw-texturing at a speed of at least 500 mpm, preferably at least 850 mpm, the feed yarn consists essentially of polymerized ethylene terephthalate residues and of trimesate or trimellitate residues acting as a chain-brancher, and the resulting package of textured yarn has not more than about 0.5 BFC and over 20 TYT. It will be understood that most commercial texturing will be carried out at higher speeds provided the texturer has a machine capable of such higher speed operation.

As will be apparent, the new feed yarns and their process of preparation make possible the provision of textured polyester yarns having increased dye-uptake and/or improved crimp, as compared with prior commercial polyester yarns textured under comparable conditions.

As will be explained hereinafter with reference to the drawings, the amount of chain-brancher is measured in MEQ, i.e. microequivalents per gram of polymer, and the optimum will depend on various considerations, especially the spinning speed, it being generally desirable to use as much chain-brancher as possible to obtain increased advantages in certain respects, whereas the amount should not be so much as will cause spinning difficulties, and this optimum will generally vary in the sense that it will be reduced as the withdrawal speed is increased. Furthermore, an advantage in dye uniformity of the textured yarns (and fabrics) has been obtained by withdrawing the filaments of the feed yarns at certain lower speeds within the speed range indicated.

DESCRIPTION OF THE PREFERRED EMBODIMENTS

Figure 1:
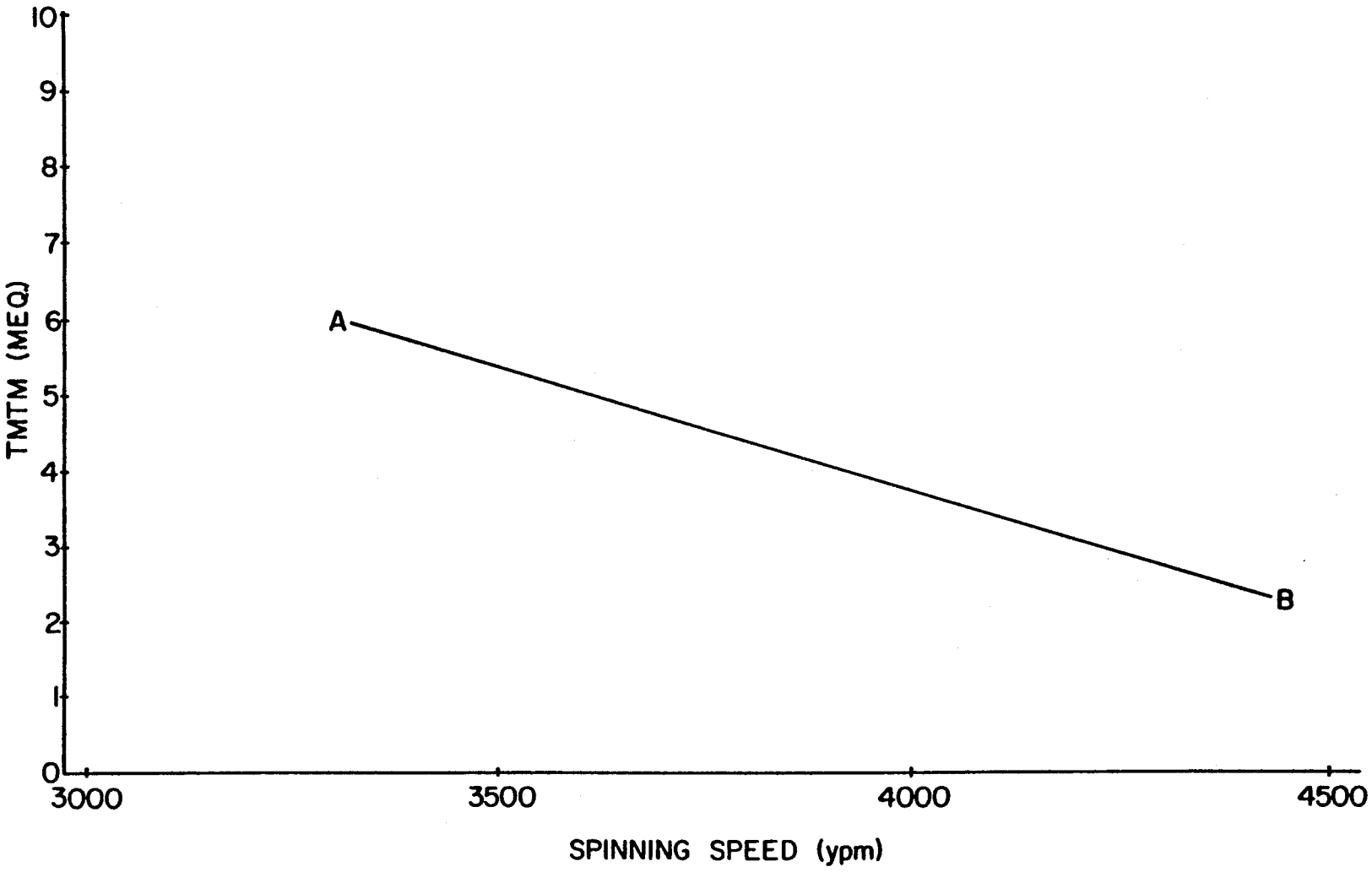
FIG. 1 is a graph showing the relationship of optimum withdrawal speed in ypm and the amount of chain-brancher in MEQ.

The preparation of the feed yarn is preferably by a continuous process in which the steps of polymerization and spinning are coupled together, because the alternative process that has been carried out in some plants of first making the polyester and then extruding it in the form of ribbons which are cooled with water and cut into pellets or flakes, which are then remelted for a separate process of spinning into filaments, can introduce uncertainties and problems, which can lead to variability in the resulting feed yarn filaments. It will be emphasized that uniformity of the polyester filaments in the feed yarn is of great importance in achieving high draw-texturing speeds without excessive broken filaments.

An important element of the invention is believed to be the use of trimellitic acid, or trimesic acid, or a derivative thereof in small amounts (e.g. 4–6 MEQ) as a chain-brancher in the process of preparation of the polyester, which is accordingly a copolymer. It is believed that such chain-branching has not previously been used commercially for the objective of producing a feed yarn capable of being draw-textured at high speeds, e.g., of 1,000 mpm, without excessive broken filaments, e.g., not more than about 0.5 BFC, while giving desirably bulky yarns, e.g. of TYT over 20. It is not, however, new to suggest the use of chain-branchers for other purposes. For instance, MacLean et al., U.S. Pat. No. 4,092,299 suggests a high draw ratio polyester feed yarn and its draw-texturing and companion U.S. Pat. No. 4,113,704 suggests a polyester filament-forming polymer and its method of production. Since the two disclosures are practically identical, only U.S. Pat. No. 4,092,299 will be discussed.

MacLean et al., U.S. Pat. No. 4,092,299 suggests improving productivity by using a chain-brancher in such amount that the polyester has 1–15 or 2–14 microequivalents of reactive branching sites per gram of polymer (MEQ), and preferably 5–12 MEQ. The increased productivity is obtained by increasing the draw ratio during draw-texturing and/or increasing the withdrawal speed during filament formation, because the orientation (birefringence) of the feed yarn is reduced by using chain-brancher. The optimum level of chain branching is discussed in column 11, and will depend on many factors. Pentaerythritol is suggested as the preferred chain brancher, but is not desirable according to the present invention, because it volatizes during polymer preparation. We have found that use of such volatile chain-brancher leads to problems and consequential lack of uniformity in the resulting filaments for the draw-texturing feed yarns. Although a volatile chain-brancher, such as pentaerythritol, may be quite adequate for operation at low texturing speeds and for MacLean's objective of increasing productivity, it is not a solution to the problem of providing a draw-texturing feed yarn capable of draw-texturing at a speed of, e.g., 1,000 mpm without excessive broken filaments, e g., not more than about 0.5 BFC, while giving a desirably bulky yarn, e.g., over 20 TYT.

According to the present invention, we have found it desirable to use a chain-brancher that is adequately stable (both in monomer form during processing and polymerization and in polymeric form during formation of the polymer and spinning into filaments and subsequent processing), not so volatile as to cause problems and variability during preparation of the polymer, and that is soluble in the catalyzed glycol for ease of addition to the reaction. Trimellitic acid and its ester derivatives fulfill all these functions, and it is believed that trimesic acid and its ester derivatives would have similar functions and advantages There are two main routes to preparing polyethylene terephthalate polyesters, namely ester interchange of dimethyl terephthalate (DMT) with ethylene glycol (EG) to form a prepolymer, followed by further polymerization, or reaction of terephthalic acid (TPA) with EG to form the prepolymer, followed by further polymerization. If the DMT route is used, then an ester, such as trimethyl trimellitate (TMTM), will be preferred, whereas trimellitic acid (TMA) will be preferred generally for the TPA route.

MacLean is not limited to the use of pentaerythritol, but covers other chain-branching agents having a functionality greater than 2, that is containing more than 2 functional groups such as hydroxyl, carboxyl or ester. Accordingly, other polyhydroxy chain branchers are mentioned, and aromatic polyfunctional acids or their esters (column 7). Trimesic acid, trimethyl trimesate and tetramethyl pyromellitate are specifically mentioned in lines 41–42, but are not used in the Examples. In Table IV, column 12, trimer acid is used in amounts 11,800 and 23,600 ppm (said to be 6.5 and 12.9 MEQ, but calculated instead as 12.9 and 25.1 MEQ, respectively) and mellitic acid (benzene hexacarboxylic acid) is used in amounts 9.8 and 14.7 MEQ. The only texturing speed mentioned by MacLean is 200 ypm (column 10, line 15). The withdrawal (spinning) speeds vary between 3,400 and 4,400 ypm in Examples 2 and 4, and are 5,500 and 6,000 ypm in Example 6, and are otherwise 3,400 ypm. Productivity (MacLean's objective), it was said, "definitely increases with spinning speed over most of the speed range capability of the equipment used" (column 11, lines 58–60), and it was impossible to determine whether the productivity curve continued to increase with spinning speed.

As will be seen in the Examples, hereinafter, wherein the DMT ester interchange route is used to prepare the polyester, the chain-brancher is conveniently dissolved in the catalyzed EG solution that is used in an otherwise conventional ester interchange reaction between DMT and EG using appropriate catalysts to prepare the prepolymer. Further polymerization (sometimes referred to as finishing) is carried out under vacuum with an appropriate material such as phosphorus again in conventional manner to prepare a polymer of the required viscosity (measured as LRV). The resulting polymer is then preferably passed continuously to the spinning unit without intermediate conversion into flake and remelting, and is spun to prepare partially oriented filaments of low crystallinity at withdrawal speeds of 3,000 mpm or more, with particular care in the spinning conditions to provide uniform filaments, to minimize breaks during the spinning or during subsequent draw-texturing operations at high speed.

TMTM has three reactive carboxyl groups of which two are reacted in the molecular chain. The other one reacts to form a side chain which is referred to as a chain branch. If and when these chain branches react with another molecule, a crosslink is formed. Obviously there are many more chain branches than crosslinks formed. Also because there are only three of these (carboxyl) reactive sites in TMTM, there is only one for chain branching. Therefore, the equivalent weight and the molecular weight are the same. 0.15% by weight of TMTM (on the weight of the polymer) is the same as 1,500 ppm and is almost 6 MEQ (5.95). Similarly, 0.10% of TMTM (1,000 ppm) is almost 4 MEQ. Trimesic acid has the same molecular weight as trimellitic acid, so the same values apply.

As indicated above, and herein elsewhere, the amount of chain-brancher must be carefully adjusted, especially according to the withdrawal speed, if the full benefits of the invention are to be obtained Optimum amounts are indicated graphically as the line AB in FIG. 1 of the accompanying drawings, plotting such optimum amounts (as MEQ) against the withdrawal speeds (in ypm) for the equipment that I have used. It will be understood that some variation can be permitted, and the exact optimum may well differ according to various factors, such as the ingredients and equipment used to make the polymer and the yarns, and operating preferences. However, as the amount of chain-brancher increases, so does the melt viscosity generally increase, and this soon causes problems, particularly in spinning, so that spinning becomes impossible because of melt fracture. However, it is generally desirable to use as much chain-brancher as possible, consistent with the above, so as to obtain the indicated benefits in the textured yarns, especially of increased crimp and dye-uptake over yarns of unmodified polymer. Thus there is a rather narrow range of proportions of chain-brancher within which I prefer to operate. As indicated, this range decreases with the withdrawal speed used to make the DTFY, since the melt viscosity increases, and accordingly spinning problems increase with increased speeds. Furthermore, the dye uniformity of the textured yarn has been better when lower withdrawal speeds have been used within the indicated range. If this is important, a withdrawal speed that is relatively low within the operational range is preferred, i.e. less than 3,500 mpm, and especially about 3,000 to 3,200 mpm. This preferred relatively low speed is surprising, being contrary to what I had expected from my knowledge of this field and of the teaching in the art. However, the speed should not be too low, since this will lead to filaments that are unstable to heat, and that may cause problems of fusing together or melting on the (first) heater of the texturing machine, or of string-up. In this respect the desirable minimum withdrawal speed is significantly more than taught by Petrille and by Piazza and Reese in U.S. Pat. No. 3,771,307 and 3,772,872 for unmodified (homopolymer) PET yarns. As indicated already, and is well known, the elongation (to break) generally decreases as the withdrawal speed increases, being a measure (inverse) of the orientation. Thus an increase in elongation (other parameters being kept constant) generally indicates a tendency to instability of the filaments to heat, whereas a decrease in elongation similarly indicates less dye uniformity. It will be understood that all the numerical parameters expressed herein will depend on the ingredients, equipment and operating preferences to some extent. The preferred value of 21 for the LRV is because too high a value will increase the melt viscosity and this leads to spinning problems, as already explained. Too low an LRV, however, tends to reduce the tensile properties, especially the toughness of the filaments, and this leads to breaks during draw-texturing. Similarly, if the shrinkage is too low, this indicates too much crystallinity, and leads to variability, which generally shows up first as reduced dye-uniformity, whereas insufficient crystallinity (too high a shrinkage) leads to variability in other respects, and can produce filaments that are not sufficiently stable to heat, as indicated above. So it will be understood that the spinning conditions must be carefully monitored, and the desired amount of chain-brancher must be carefully selected, and is affected by the speed of withdrawal, which may be selected according to the properties desired in the eventual textured yarns. If dye uniformity is essential, then a lower speed of about 3,000 mpm may be preferred. If better crimp properties are more important, then higher withdrawal speeds may be preferred. As the withdrawal speed rises, however, there comes a point when the presence of chain-brancher does not apparently continue to improve crimp properties, although other advantages, such as of improved dye-uPtake will still apply.

The use of chain-brancher has been noted to provide significantly higher spinning tensions, than with unmodified polymer. This is believed to be an important advantage in the process of the invention.

As indicated, an important advantage in the resulting textured yarns, obtained by draw-texturing of the improved modified feed yarns of the present invention, is the low number of broken filaments (BFC) obtained even when the texturing is carried out at the very high speeds indicated. The resulting textured yarns also have other advantages. As can be seen from the Examples herein, the dyeability, or dye-uptake, is improved This, in retrospect, may not seem so surprising, since there have been several prior suggestions of using other trifunctional chain-branching agents in polyester polymers in much larger amounts (0.5–0.7 mole percent, i.e. about 10 times as much) in order to obtain better dyeability, oil-stain release or low pilling, as mentioned in column 1 of MacLean. However, despite these general suggestions of improving such properties in the prior art, it is believed that no one has previously actually made a textured polyester fiber of improved dyeability by incorporating a trimellitate or trimesate chain brancher in the polymer used to make the DTFY.

A further improvement in the textured yarns, believed to be a result of the chain-branching according to the invention, is the improved crimp properties, as shown by the CCA and TYT values in the Examples. This is an important advantage commercially. In practice, it is necessary to operate the draw-texturing process so as to obtain textured yarn having at least equivalent crimp properties to those that are already available commercially. The crimp properties can be adjusted to some extent by varying the draw-texturing conditions, and this can also depend on the skill and knowledge of the texturer, who may be forced to reduce the texturing speed in order to improve the crimp properties of the resulting textured yarn. Thus, a desirable objective for the texturer is to achieve or surpass the target crimp properties, while reducing his costs by operating at the maximum possible speed.

The invention is further illustrated in the following Examples The yarn properties are measured as in U.S. Pat. No. 4,134,882 (Frankfort and Knox) except as follows.

BFC (Broken Filament Count) is measured as indicated hereinabove in number of broken filaments per pound of yarn. In practice, a representative number of yarn packages are evaluated and an average BFC is obtained by visually counting the total number of free ends on both ends, and dividing by the total weight of yarn on these packages.

TYT (Textured Yarn Tester) measures the crimp of a textured yarn continuously as follows The instrument has two zones. In the first zone, the crimp contraction of the textured yarn is measured, while in the second zone residual shrinkage can be measured Only the first zone (crimp contraction) is of interest, however, for present purposes. Specifically, the textured yarn is taken off from its package and passed through a tensioning device which increases the tension to the desired level, 10 grams for 160 denier yarn (0.06 gpd). The yarn is then passed to a first driven roll, and its separator roll, to isolate the incoming tension from the tension after this first roll. This roll is hereafter referred to as the first roll. Next, in this first zone, the yarn is passed through a first tension sensor, and through an insulated hollow tube, which is 64,5 inches (~164 cm) long and 0.5 inches (1.27 cm) in diameter and which is maintained at 160° C., to a second set of rolls, a driven roll and a separator, which isolate the tension in the yarn in the first zone from that in the next zone, and to a third set of rolls, a driven roll and a separator roll, which further isolates the tension in zone one from the tension in zone two. The circumferential speed of roll three is set enough faster than roll two so that roll two imparts 2 grams tension to a 160-denier threadline (~0 013 gpd), and rolls two and three are controlled by the first tension sensor at such speeds as to insure that the tension in zone one is that desired, (~0 001 gpd). When the yarn leaves the third set of rolls, it is passed through a second sensor and thence to a fourth set of rolls which isolate the tension in the second zone from any windup tension or waste jet. The speed of the fourth set of rolls is controlled by the second sensor and that tension is set at 10 grams for a 160-denier yarn or 0.0625 gpd. Of course, the total tensions will change with a change in denier of the textured yarn. As indicated, only the relative speeds in and out of the first zone are of interest in this instance.

The TYT is calculated as a percentage from the circumferential speeds $V_1$ of the first roll and $V_2$ of the second roll:

$$TYT = \frac{V_1 - V_2}{V_1} \times 100$$

CCA (Crimp Contraction) of textured yarns is determined in the following manner: A looped skein having a denier of 5,000 is prepared by winding the textured yarn on a denier reel. The number of turns required on the reel is equal to 2,500 divided by the denier of the yarn. A 500 gm. weight is suspended from the looped skein to initially straighten the skein. This weight is then replaced by a 25-gram weight to produce a load of 5.0 mg/denier in the skein. The weighted skein is then heated for 5 minutes in an oven supplied with air at 120° C., after which it is removed from the oven and allowed to cool While still under the 5.0 mg/denier load, the length of the skein, $L_c$, is measured The lighter weight is then replaced by the 500-gm. weight and the length of the skein, $L_e$, is measured again. Crimp Contraction is then expressed as a percentage which is calculated by the formula:

$$CCA = \frac{L_e - L_c}{L_e} \times 100$$

Dye Uptake—Each yarn was knitted into a tubing using a Lawson Hemphill FAK knitter. The knit tubing was scoured, dyed at 265° F. using Eastman Polyester Blue GLF (Dispersed Blue 27 No. 60767), rescoured, dried, flattened and the light reflectance of the various sections of the tubing measured with a "Color Eye Instrument", which is marketed by the Macbeth Corporation. Reflectance values are converted into K/S values using the Kubelka-Munk function, which is the theoretical expression relating reflectance of dyed yarn (in this case in tubing), to the concentration of the dye in the fiber Sections of a "control yarn" are knitted into each tubing so that all K/S values can be rationalized, i.e., expressed in "% Dye Uptake" vs. this control as standard.

EXAMPLE 1

Copolymer for the new and improved feed yarn for draw texturing (DTFY) is prepared by copolymerizing dimethyl terephthalate (DMT), ethylene glycol (EG) and about 4.3 MEQ trimethyl trimellitate (TMTM) (about 4 3 microequivalents per gram of DMT) 4.3 MEQ is 0.11% of TMTM per gram of copolymer. The TMTM is dissolved in and added with the catalyzed glycol. At the concentration required, the TMTM is completely soluble in the catalyzed glycol and neither enhances nor inhibits the catalytic properties of the manganese and antimony salts which are used as catalysts Catalyst contents are identical to those used for standard PET. The required amount of phosphorus, either as an acid or salt, is added when the exchange is complete and before proceeding with polymerization to inactivate the manganese catalyst during polymerization. 0.3% of TiO: based on DMT is added, as a glycol slurry to the material, after the exchange is complete and before the polymerization, to provide opacity in the resulting DTFYs. It is found that the addition, exchange and polymerization process conditions used for standard PET are acceptable. Indeed, the polymerization proceeds faster for the new copolymer. In the preparations used herein, both the copolymer and the standard (linear polymer) PET (used as control) were prepared in a continuous polymerization process. It is found that the resulting new copolymer has a LRV slightly higher than that of the control, somewhat more than 21 vs. standard polymer of about 20.5. The new copolymer also had a slightly higher melt viscosity than the control. This increased melt viscosity was not enough to cause problems in polymer making, polymer transport or spinning. The polymer is pumped from the continuous polymerizer to the spinning machines where it is spun into the new and improved feed yarn for draw texturing.

The new copolymer is pumped through a filter pack and thence through a spinneret which has 34 capillaries, each 15×60 mils (diameter×length). Spinning temperatures are somewhat higher than those required for standard PET (about 300° C. vs. about 293° C. for the standard PET). The extruded filaments are quenched by passing room temperature air across the filaments below the spinneret, using the same cross-flow system as for the standard PET filaments. The amount of air flow across the filaments is adjusted to obtain the best operability. Finish is applied after the filaments are quenched. Filaments are then converged into a threadline and handled as a threadline thereafter This threadline is passed at 4,000 ypm (3,600 mpm) around the first godet, called a feed roll, thence to a second godet, called a let-down roll, through an interlace device and thence to an appropriate wind-up at about 4,000 ypm. The circumferential speed of the let-down godet is adjusted to give the tension between the feed and let-down godets that provides the best spinning continuity. These conditions were essentially the same as for standard yarn. Spinning continuity was found to be excellent. Packages of the new DTFY were judged to be at least as good as those from the standard yarn.

The DTFY has tensile and other physical properties that are acceptable for DTFY. These properties are set out and compared with standard PET control DTFY in Table IA. Because the new DTFY is spun at 4,000 ypm, but has orientation properties (elongation and birefringence) more like standard POY spun at 3,500 ypm, standard POY spun at each speed was prepared and used as control. The crystallinity of the new DTFY is greater than either control (density and C.I.).

Each DTFY is textured on a laboratory model, Barmag FK6-900 texturing machine, which is equipped for friction false twist texturing, with as disc stack a Barmag T-6 arrangement, using a 0-9-0 array of "Kyocera" ceramic discs with a spacing of 0.75 mm. Texturing speed comparisons are made over the speed range from 750 to 1,150 mpm, incremented in 100 mpm intervals. The draw ratio to avoid surging for each yarn is determined and used. The temperatures of the first and second heater plates are set at 220° C. and 190° C., conditions used by many in the trade for PET yarns. During texturing, practically no breaks occurred with the new yarn at any of these speeds. In contrast, there were several breaks for the control yarns, especially at higher speeds, such as at 950 mpm, more at 1,050 mpm, and neither control would run at all at 1,150 mpm, i.e. it was not possible to draw-texture either control yarn at this speed. The pre-disc and the post-disc tensions were measured for each yarn at each texturing speed. The textured yarns are tested for textured yarn properties of broken filaments (BFC), and TYT and CCA crimp properties and Dye Uptake with the results summarized in Table IB.

These results show that the new DTFY has very substantial advantages vs. either control yarn in the very important property of broken filaments (BFC), especially at the higher texturing speeds of more than 1,000 mpm, higher crimp properties (TYT and CCA), and greater dye uptake.

It will be noted that Table IB contains textured yarn properties for the new yarn at texturing speeds of 750 through 1150 mpm, but for the control yarns only at speeds of 850 through 1050 mpm. As expleained above, neither control yarn could be run at 1150 mpm; (in addition, it will be noted that the control spun at the lower speed of 3200 mpm gave unsatisfactory results at lower texturing speeds, of 850, 950 and 1050 mpm, as regards broken filaments, and that the control spun at the higher speed of 3660 mpm gave significantly more broken filaments then the new yarns, spun at the same speed). Some control yarns were indeed textured at 750 mpm, but have not been included in this Table IB as they were run somewhat differently so were not strictly speaking comparative tests; (such controls did however give 0.36 and 0.46 BFC, respectively, and 25 and 27 TYT, 4.9 and 4.7 CCA and 92 and 98 Dye Uptake, respectively, for the higher and lower withdrawal speeds indicated, i.e. the results were relatively poor by my standards, but adequate by prior art standards, for this texturing speed).

EXAMPLE 2

Table IIB shows that the performance of the DTFY decreases as the TMTM content is decreased below about 4 MEQ. Example 1 is repeated for items S, X, V and Y, except that the concentration of TMTM is changed as shown in Table IIA. There are no problems in polymer making, polymer transport or spinning, except for item Y, wherein almost 6 MEQ were used, so the melt viscosity increased and this caused some problems in spinning. When the TMTM concentration is increased slightly further to 6.3 MEQ, spinning continuity is so poor, with individual filaments pulling away from the spinneret, that this either causes the spinning threadline to break or the free end filament is recaptured by the threadline and carried to the wind-up. Such free end filaments are very serious defects, and cause problems in subsequent texturing and, in fabric, give harsh spots. When such fabric is dyed these "free-ends" dye deeply and give a very serious and unwanted "spotty" appearance to the fabric. At these higher TMTM contents, filament "fall-out" becomes such a serious problem that spinning is called "Impossible", because of "Melt-Fracture". Changes in spinning conditions, generally used to reduce or eliminate "Melt Fracture" in PET, did not correct the problem with TMTM copolymers where the content is about 6.3 MEQ. Similar problems of spinning continuity exist at 5.9 MEQ (item Y), but filaments can be spun with poor continuity, and so the properties have been measured for item Y.

Figure 2:
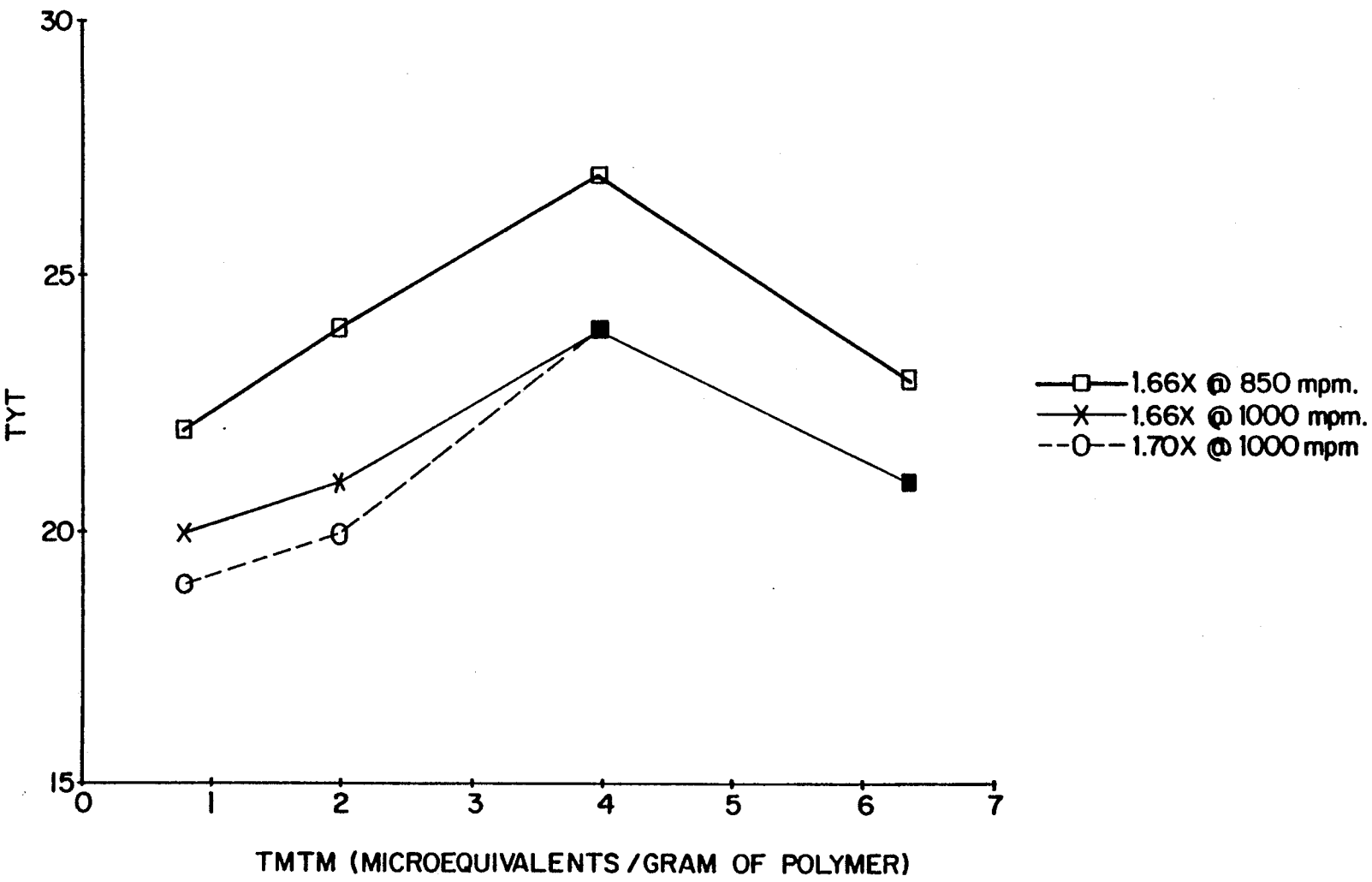
FIG. 2 is a graph plotting crimp properties (TYT) against the amount of chain-brancher used in Example 2.

Each such yarn is textured on a Barmag M-80, but otherwise as in Example 1. Operability was excellent, even at 1,000 mpm. Each textured yarn was evaluated for textured yarn properties, and compared with controls E and B spun at 3,500 ypm and 4,000 ypm without TMTM in Table IIB. Broken filaments are much fewer of the TMTM-containing yarns than for the control, but item X (containing less than 1 MEQ of TMTM) gave some results of borderline acceptability. The TYT crimp properties of these yarns is best understood from the plot of TYT vs. TMTM content (MEQ) shown as FIG. 2. The preferred concentration is about 4 MEQ of TMTM at this withdrawal speed (4,000 ypm).

EXAMPLE 3

This Example shows the spinning of the new yarn at a spinning speed of 3,500 ypm (3,200 mpm), in the preferred range, and the change in properties as the TMTM content is varied at this spinning speed, following essentially Example 1 in other respects. At this speed of 3,500 ypm (3,200 mpm), it is found that the concentration of TMTM can be increased to levels of 6.3 MEQ and still obtain feed yarn acceptable for draw texturing. Polymers can be made without serious problems at concentrations even higher than about 6.3 MEQ, even up to about 8 MEQ. As the TMTM concentration increases from 3.9 MEQ to about 6.3 MEQ, the melt viscosity for the required Relative Viscosity increased significantly. The increase is, however, readily compensated for in polymer making and spinning at 3,500 ypm (3,200 mpm) by moderate and acceptable increases in temperature. However, as the TMTM concentration is increased from about 6.3 MEQ to about 8 MEQ melt viscosity increases sharply, for the desired relative viscosity, and I could not compensate for this increase in melt viscosity by using higher temperatures in polymer making, polymer transport and especially in spinning. Specifically in spinning, the higher melt viscosity sharply increases the melt fracture of the spinning filaments with the accompanying defects in the as-spun yarn and a very sharp increase in the number of spinning breaks. The usual corrective actions of adjusting spinning temperature, varying capillary dimensions and adjusting quench did not overcome the problems, especially at a TMTM concentration of about 7.9 MEQ and higher.

Table III compares the spinning conditions used and the properties of the DTFY for the two TMTM-chain branched yarns selected for further evaluation and a control without any TMTM. The best spinning temperature found for each polymer summarized in the Table. The denier of each feed yarn was set during yarn preparation to give approximately 150 denier textured yarn.

Each yarn was textured at texturing speeds from 750 mpm to 1,050 mpm, incremented in 100 mpm intervals, on the FK6-900 as in Example 1, and the results are summarized in Table III; (in this regard the texturing tensions given in the right hand column of Table III are believed correct; however, the calibration standard of the instrument was changed, so the values are not so certain as others herein). At the lowest texturing speed, the BFC is not dramatically better for the TMTM chain branched yarn than for the control. However, as the texturing speed is increased to 850 mpm and above, both TMTM chain branched yarns show a much lower BFC level than the control, which is unacceptable. When the two TMTM chain branched yarns are compared, the higher level of TMTM chain branched yarn is much better in BFC than the lower level. Thus, it is clear that, when making optimum DTFY at these lower withdrawal speeds, one must use more TMTM than is desirable at a higher withdrawal speed (Example 2). It is also clear that more optimization is desirable to obtain a DTFY at this withdrawal speed that will give less than 0.5 BFC. In crimp properties of TYT and CCA, the TMTM crosslinked yarns are also better than the control; these higher yarn crimp properties translate into higher bulk and a more pleasing hand in fabrics. Again the higher TMTM chain branched yarn has higher textured yarn crimp properties than the lower TMTM chain branched. Finally, in dye uptake, both TMTM chain branched yarns have higher dye uptake than the control and again the higher level of TMTM chain branched yarn has the higher dye uptake. Significantly better dye uniformity is noted at these lower preferred spinning speeds, which are contrary to the preference expressed by MacLean, who had an entirely different objective.

As will be appreciated, for a valid comparison, the operating conditions must be comparable. For instance, different results have been obtained with the same DTFY on two texturing machines of different types made by the same manufacturer.

It is well known that better bulk can be obtained, in general, by increasing the temperature of the (first) heater appropriately during texturing, when using standard linear polymer as DTFY. When using sufficient amounts of chain-brancher according to the invention, I have obtained similar levels of bulk and dye uniformity (under standard conditions at 265° F) at lower texturing temperatures (e.g. about 220° C) as I obtained at higher texturing temperatures (e.g. about 240° C) when using standard linear polymer as DTFY, and then I have been able to obtain textured yarn that is improved in these respects by using higher texturing temperatures (such as about 240° C.) with the chain-branched DTFY provided sufficient chain-brancher is used according to the present invention.

I believe that, if trimethyl trimesate is substituted for trimethyl trimellitate in the foregoing Examples, essentially similar results would be obtained.

TABLE IA

| Identification | Control | Control | New Yarn |
|---|---|---|---|
| TMTM (MEQ) | 0 | 0 | 4.3 |
| Count | 250-34-R | 235-34-R | 245-34-R |
| Spinning Conditions | | | |
| Temperature (°C.) | 293 | 293 | 300 |
| Spinneret | | | |
| No. Capillaries | 34 | 34 | 34 |
| Diversions | 15 × 60 | 15 × 60 | 15 × 60 |
| Spin Speed | | | |
| (YPM) | 3500 | 4000 | 4000 |
| (MPM) | 3200 | 3660 | 3660 |
| Spun Yarn Properties | | | |
| Denier | 249 | 235 | 246 |
| Modulus | 23 | 29 | 27 |
| Tenacity | 2.36 | 2.67 | 2.14 |
| Elongation | 127 | 102 | 134 |
| T(Break) | 5.22 | 5.39 | 5.02 |
| BOS | 61 | 51 | 22 |
| Birefringence | 0.0384 | 0.0506 | 0.0351 |
| Density | 1.3426 | 1.3452 | 1.3491 |
| CI | 6.5 | 8.5 | 12 |
| Interlace (cm) | 9 | 9 | 9 |

TABLE IIA

| Identification | | | | |
|---|---|---|---|---|
| Item | S | Y | V | X |
| TMTM (MEO) | 4.0 | 5.9 | 2.0 | 0.8 |
| TMTM (% OWP) | 0.10 | 0.15 | 0.05 | 0.02 |
| Count (Spun) | 255-34-R | 255-34-R | 255-34-R | 255-34-R |
| Spinning Conditions | | | | |
| Temperature | 292 | 292 | 292 | 292 |
| Spinneret | | | | |
| No capillaries | 34 | 34 | 34 | 34 |
| Dimension | 15 × 60 | 15 × 60 | 15 × 60 | 15 × 60 |
| Spin Speed | | | | |
| YPM | 4000 | 4000 | 4000 | 4000 |
| MPM | 3660 | 3660 | 3660 | 3660 |
| Spun Yarn Properties | | | | |
| Denier | 255 | 253 | 256 | 255 |
| Modulus | 25 | 27 | 25 | 27 |
| Tenacity | 2.30 | 1.90 | 2.39 | 2.57 |
| Elongation | 130 | 137 | 123 | 110 |
| T(break) | 5.30 | 4.50 | 5.33 | 5.40 |
| BOS | 21 | 16 | 28 | 48 |
| Birefringence | 0.0340 | — | 0.0400 | 0.0463 |
| Density | 1.3488 | 1.3508 | 1.3444 | 1.3442 |
| CI | 12 | 13 | 8 | 7.7 |
| Interlace (cm) | 7 | 7 | 7 | 8 |

*Viscosity of yarns 21 ± 1 LRV.

TABLE IIB

| TMTM | | | TEXTURING | TEXT SPEED | TENSIONS | | | |
|---|---|---|---|---|---|---|---|---|
| ITEM | MEQ | % | DRAW RATIO | MPM | PRE-DISC | POST-DISC | BFC | TY |
| X | 0.8 | 0.02 | 1.66 | 850 | 107 | 113 | 0.25 | 22 |
| | | | 1.66 | 1000 | 108 | 129 | 0.39 | 20 |
| | | | 1.70 | 1000 | 118 | 137 | 0.52 | 19 |
| | | | 1.60 | 1000 | 79 | 102 | 0.48 | 20 |
| S | 4.0 | 0.10 | 1.66 | 850 | 83 | 88 | 0.39 | 27 |
| | | | 1.66 | 1000 | 86 | 93 | 0.34 | 24 |
| | | | 1.70 | 1000 | 92 | 108 | 0.09 | 24 |
| V | 2.0 | 0.05 | 1.66 | 850 | 97 | 112 | 0.23 | 24 |
| | | | 1.66 | 1000 | 90 | 110 | 0.32 | 21 |
| | | | 1.70 | 1000 | 113 | 126 | 0.43 | 20 |
| | | | 1.60 | 1000 | 74 | 90 | 0.40 | 22 |
| Y | 5.9 | 0.15 | 1.66 | 850 | 87 | 105 | 0.16 | 23 |
| | | | 1.66 | 1000 | 92 | 109 | 0.13 | 21 |
| | | | 1.70 | 1000 | 107 | 118 | 0.23 | 21 |
| | | | 1.60 | 1000 | 80 | 92 | 0.36 | 22 |
| B | Control | 0 | | | | | | |
| | (4000 ypm) | | 1.56 | 850 | 72 | 84 | 1.13 | 21 |
| | (3660 mpm) | | 1.56 | 1000 | 72 | 84 | 1.17 | 20 |
| | | | 1.52 | 1000 | 65 | 82 | 1.13 | 18 |
| | | | 1.60 | 1000 | 81 | 96 | 1.27 | 20 |
| E | Control | 0 | 1.76 | 850 | 65 | 77 | 1.25 | 21 |
| | (3500 ypm) | | 1.76 | 1000 | 71 | 87 | 2.17 | 21 |
| | (3200 mpm) | | 1.72 | 1000 | 65 | 88 | 1.86 | 15 |
| | | | 1.80 | 1000 | 76 | 90 | 2.98 | 21 |

TABLE III

| Feed Yarn Identification | | | | | | | | | | | |
|---|---|---|---|---|---|---|---|---|---|---|---|
| TABLE IB | | | | | | | | | | | |
| Identification | New Yarn | | | | | Control | | | Control | | |
| TMTM MEQ | 4.3 | | | | | 0 | | | 0 | | |
| Feed Yarn Spin Speed (ypm) | 4000 | | | | | 4000 | | | 3500 | | |
| (mpm) | 3600 | | | | | 3660 | | | 3200 | | |
| Texturing Conditions | | | | | | | | | | | |
| Texturing Speed mpm | 750 | 850 | 950 | 1050 | 1150 | 850 | 950 | 1050 | 850 | 950 | 1050 |
| FK6-900 | | | | | | | | | | | |
| BFC | 0.03 | 0.07 | 0.08 | 0.1 | 0.26 | 0.37 | 0.47 | 0.57 | 1.04 | 1.03 | 1.40 |
| TYT | 29 | 27 | 24 | 23 | 17 | 25 | 22 | 21 | 25 | 23 | 21 |
| CCA | 5.3 | 4.9 | 4.6 | 4.2 | 2.4 | 4.5 | 4.1 | 3.9 | 4.7 | 4.2 | 3.9 |
| Dye Uptake | 189 | 195 | 196 | 180 | 192 | 91 | 89 | 80 | 100 | 104 | 110 |
| Pre-disc | 80 | 78 | 79 | 85 | 86 | 72 | 78 | 75 | 72 | 79 | 85 |
| Post-disc | 89 | 87 | 88 | 95 | 127 | 86 | 90 | 92 | 80 | 90 | 98 |
| Draw Ratio | 1.56 | 1.56 | 1.56 | 1.61 | 1.63 | 1.45 | 1.47 | 1.56 | 1.71 | 1.75 | 1.79 |

TABLE III-continued

| | | | |
|---|---|---|---|
| TMTM (MEQ) | 0 | 3.9 | 6.3 |
| TMTM (% OWP) | 0 | 0.10 | 0.16 |
| Count | 265-34-R | 285-34 R | 285-34 R |
| Spinning Conditions | | | |
| Temperature | 285° C. | 300° C. | 304° C. |
| Spinneret | | | |
| Spun Yarn Properties | | | |
| Denier | 266 | 284 | 283 |
| Modulus | 29 | 23 | 24 |
| Tenacity | 2.45 | 2.12 | 1.96 |
| Elongation | 124 | 149 | 152 |
| T(break) | 5.49 | 5.28 | 4.94 |
| BOS | 57 | 51 | 44 |
| Density | 1.3439 | 1.3429 | 1.3431 |
| CI | 7.4 | 6.5 | 6.7 |
| Birefringence | 0.0350 | 0.0316 | 0.0298 |
| Pin Count | 12 | 10 | 10 |
| Texturing Conditions | | | |
| Texturing Speed | | | |
| 750 mpm | | | |
| BFC | 0.42 | 0.48 | 0.33 |
| TYT | 27 | 27 | 29 |
| CCA | 4.2 | 4.3 | 4.3 |
| Dye Uptake | 111 | 139 | 152 |
| Pre-disc | 79 | 87 | 89 |
| Post-disc | 102 | 108 | 110 |
| Draw Ratio | 1.71 | 1.72 | 1.72 |
| 850 mpm | | | |
| BFC | 1.1 | 0.77 | 0.41 |
| TYT | 25 | 25 | 27 |
| CCA | 3.8 | 3.9 | 3.8 |
| Dye Uptake | 111 | 139 | 157 |
| Pre-disc | 80 | 85 | 84 |
| Post-disc | 104 | 106 | 110 |
| Draw Ratio | 1.71 | 1.72 | 1.72 |
| 950 mpm | | | |
| BFC | 1.7 | 0.83 | 0.54 |
| TYT | 22 | 24 | 25 |
| CCA | 3.7 | 3.7 | 3.5 |
| Dye Uptake | 105 | 140 | 159 |
| Pre-disc | 83 | 90 | 86 |
| Post-disc | 108 | 109 | 112 |
| Draw Ratio | 1.74 | 1.72 | 1.72 |
| 1050 mpm | | | |
| BFC | 14.0 | 0.84 | 0.56 |
| TYT | 18 | 22 | 23 |
| CCA | 3.4 | 3.4 | 3.2 |
| Dye Uptake | 101 | 141 | 160 |
| Pre-disc | 81 | 86 | 79 |
| Post-disc | 113 | 107 | 91 |
| Draw Ratio | 1.79 | 1.72 | 1.72 |

I claim:

1. A continuous process for preparing polyester draw-texturing feed yarns, involving the steps of first forming a molten polyester by reaction, in the presence of catalysts therefor, (a) of ethylene glycol with terephthalic acid and/or esters thereof, followed by (b) polycondensation, and then melt-spinning the resulting molten polyester into filaments and withdrawing them at a speed of about 3,000 to 4,000 mpm to provide partially oriented yarns of low crystallinity, wherein the polyester is modified by introducing into the polymer, as a solution in ethylene glycol, trimellitic acid, trimesic acid or an ester of either acid, in a small amount, measured as microequivalents per gram of polymer (MEQ), that depends on the speed (V), in ypm, at which the filaments are withdrawn, the optimum amounts being as indicated by the line AB of FIG. 1 of the accompanying drawings.

2. A process for preparing a package of false-twist-textured yarn, wherein a multifilament polyester feed yarn is subjected to simultaneous draw-texturing at a speed of at least 500 mpm, the feed yarn consists essentially of polymerized ethylene terephthalate units, chain-branched with trimellitate or trimesate units in such amount that the resulting package of textured yarn has not more than about 0.5 BFC, and over 20 TYT.

3. A continuous process for preparing polyester draw-texturing feed yarns, involving the steps of first forming a molten polyester by reaction, in the presence of catalysts therefor, (a) of ethylene glycol with terephthalic acid, terephthalate esters, or both, followed by (b) polycondensation and then melt-spinning the resulting molten polyester into filaments and withdrawing them at a speed of about 3,000 to 4,000 mpm to provide partially oriented yarns of low crystallinity, wherein the polyester is modified by introducing into the polymer, as a solution in ethylene glycol, trimellitic acid, trimesic acid or an ester of either acid in a small amount, measured as microequivalents per gram of polymer (MEQ), that depends on the speed (V), in ypm, at which the filaments are withdrawn, the optimum amounts being as indicated by the line AB of FIG. 1 of the accompanying drawings.

4. A process according to claim 3, characterized in that the filaments are withdrawn at a speed of about 3,000–3,200 mpm.

5. A process for preparing a false-twist-textured yarn, wherein a multifilament polyester feed yarn is subjected to simultaneous draw-texturing at a speed of at least 500 mpm, the feed yarn consists essentially of polymerized ethylene terephthalate residues and of trimellitate or trimesate residues acting as a chain brancher, and the resulting package of textured yarn has not more than about 0.5 BFC, and over 20 TYT, wherein said feed yarn is prepared by melt spinning a molten polyester into filaments and withdrawing them at a speed of about 3,000 to 4,000 mpm to provide a partially oriented yarn of low crystallinity, wherein the polyester is modified by introducing into the polymer, as a solution in ethylene glycol, trimellitic acid, trimesic acid or an ester of either acid in a small amount, measured as microequivalents per gram of polymer (MEQ), that depends on the speed (V), in ypm, at which the filaments are withdrawn, the optimum amounts being as indicated by the line AB of FIG. 1 of the accompanying drawings.

6. A process according to claim 5, wherein the texturing speed is at least 850 mpm.

* * * * *